US006234858B1

(12) United States Patent
Nix

(10) Patent No.: US 6,234,858 B1
(45) Date of Patent: May 22, 2001

(54) RESILIENT CRUSHABLE FOAM OBJECTS WITH INTERCHANGEABLE PARTS

(76) Inventor: Jon O. Nix, 14012 - 80th St., E., Puyallup, WA (US) 98372

( * ) Notice: Subject to any disclaimer, the term of this patent is extended or adjusted under 35 U.S.C. 154(b) by 0 days.

(21) Appl. No.: 09/288,890

(22) Filed: Apr. 9, 1999

Related U.S. Application Data

(60) Provisional application No. 60/081,352, filed on Apr. 10, 1998.

(51) Int. Cl.[7] ..... A63H 3/16

(52) U.S. Cl. ..... 446/97; 446/101; 446/385; 446/387

(58) Field of Search ..... 446/97, 101, 268, 446/368, 385, 387

(56) References Cited

U.S. PATENT DOCUMENTS

| | | | | |
|---|---|---|---|---|
| 1,229,580 | | 6/1917 | Brown | 273/157 R |
| 2,011,714 | | 8/1935 | Freidman | 446/87 |
| 2,438,391 | * | 3/1948 | Gallagher | 446/97 |
| 2,457,249 | * | 12/1948 | Lipschitz | 446/97 |
| 2,731,766 | | 1/1956 | Rubin | 446/99 |
| 2,760,302 | | 8/1956 | Cheskin | 446/387 |
| 2,830,402 | | 4/1958 | Schleich | 446/385 |
| 2,952,462 | * | 9/1960 | Planin | 446/385 X |
| 3,097,446 | | 7/1963 | Packer | 446/385 |
| 3,236,007 | | 2/1966 | Abeson | 446/374 |
| 3,365,198 | | 1/1968 | Hay | 273/157 R |
| 4,570,936 | | 2/1986 | Meiser | 273/157 R |
| 4,881,915 | | 11/1989 | Liaw | 446/153 |

FOREIGN PATENT DOCUMENTS

| | | | | |
|---|---|---|---|---|
| 468869 | * | 11/1928 | (DE) | 446/97 |
| 974505 | * | 2/1951 | (FR) | 446/97 |

* cited by examiner

*Primary Examiner*—John A. Ricci
(74) *Attorney, Agent, or Firm*—R. Reams Goodloe, Jr.

(57) ABSTRACT

Deformable foam toys and puzzles. Novel resilient foam puzzles can be removed from puzzle form and converted into a three dimensional objects, such as toy foam animals. The objects preferably include interchangeable parts, and more preferably include articulating appendages which are interchangeably attachable to a body portion at pivot structures that are affixed to, or which extend thru, the body portions. Preferably, pivot structures are formed by resilient foam pivot pins having deformable retaining caps at opposing ends thereof, which, in the case of foam animals, serve to retain articulating limbs. Alternately, a hex-shaped socket aperture defined by a wall edge portion is provided as a joint socket in one or more of the limbs, and a parallepiped, and preferably an elongated rectangular shoulder pin or hip pin is provided for displaceable frictional engagement with the hex shaped socket to articulate the limbs to desired positions. In animal form, such foam articles provide an interesting, attention focusing toy for children. Various designs can be used to increase the variety of shapes, sizes, and colors. The toys can be made in the shape and size appropriate to suggest any desired objects or animal species. The design provides an interesting novel structure for assembling toy animals.

17 Claims, 13 Drawing Sheets

RESILIENT CRUSHABLE FOAM OBJECTS WITH INTERCHANGEABLE PARTS

This appln claims the benefit of Provisional No. 60/081,352 filed Apr. 10, 1998.

FIELD OF THE INVENTION

My invention relates to a toy, and more generally, to ornamental objects which may be crushed or otherwise deformed without damage, and which are capable of returning to their original shape after the deforming forces are removed from the object.

BACKGROUND

A wide variety of children's toys and various ornamental objects are made of rubber compounds which are formulated for resiliency, elasticity, strength, and other important properties.

I am aware of various attempts in which an effort has been made to provide an improved toy which has retarded resiliency. Such designs are largely characterized by the use of rubber compounding formulations which result in designs that have a "slow motion" return to the undistorted shape. One such design is shown in U.S. Pat. No. 2,830,402, issued Apr. 15, 1958, to J. A. Jones for ORNAMENTAL TOYS POSSESSING RETARDED RESILIENCY. In one embodiment, his invention provides a solid elongated body of substantial thickness that is made of a resilient material of essentially low molecular weight polyvinyl chloride, and a resiliency retarding ingredient so that the return to the original shape, after deformation, will be relatively slow.

OBJECTS, ADVANTAGES, AND NOVEL FEATURES

I have now invented, and disclose herein, a novel, design for flexible, resilient foam animals which may be packaged in the form of puzzle parts, and which can be assembled into characters or animals having interchangeable, moveable limbs. When animals are provided, the foam objects are adapted to being interchangeably assembled, and to having limbs articulated about pivot assembly points. My resilient foam objects are simple, lightweight, relatively inexpensive and easy to manufacture, and otherwise superior to those designs heretofore used or proposed, in so far as I am aware.

From the foregoing, it will be apparent to the reader that one important and primary object of the present invention resides in the provision of a novel foam toy susceptible of being manually assembled.

Other important but more specific objects of the invention reside in the provision of a novel foam toy as described herein which:

- can be manufactured in a simple, straightforward manner with commonly available manufacturing procedures such as water jet cutting techniques, or with die stamping techniques from commonly available foam materials;
- in conjunction with the preceding object, have the advantage that they can be easily left in position in the material from which they are formed, in order to provide a "puzzle" having insert shapes corresponding to various body portions for the selected object;
- which in a relatively inexpensive manner can be provided in a variety of shapes and sizes to produce animals or other objects of any imaginable shape, size, or color.

Other important objects, features, and additional advantages of my invention will become apparent to the reader from the foregoing and the appended claims and as the ensuing detailed description and discussion proceeds in conjunction with the accompanying drawing.

SUMMARY OF THE INVENTION

I have now invented and disclose herein a novel puzzle which can be removed from the puzzle form and converted into a three dimensional object such as a toy foam animal. Such a foam animal preferably includes interchangeable body parts, and more preferably includes articulating appendages which are interchangeably attachable to the body at pivot structures that are affixed to, or which extend thru, the body portions of the foam animal. In one embodiment, pivot structures are formed by resilient foam pivot pins having deformable retaining caps at opposing ends thereof, which, after attachment of articulating limbs, serve to retain the limbs. In another embodiment, the pivot pins act against hex-socket shaped apertures (defined by wall edge portions) that are located on each limb.

The novel foam animal provides a simple, interesting, attention focusing toy for children. Various designs can be used to increase the variety of shapes and sizes of the animals, and the toys can be made in the shape and size appropriate to suggest any desired species, whether it be dinosaurs, turtles, farm animals, pets, reptiles or any other selected design. This design provides a most interesting novel structure for assembling toy objects, and especially toy animals, compared to previous designs known to me.

DESCRIPTION

Figure 1:
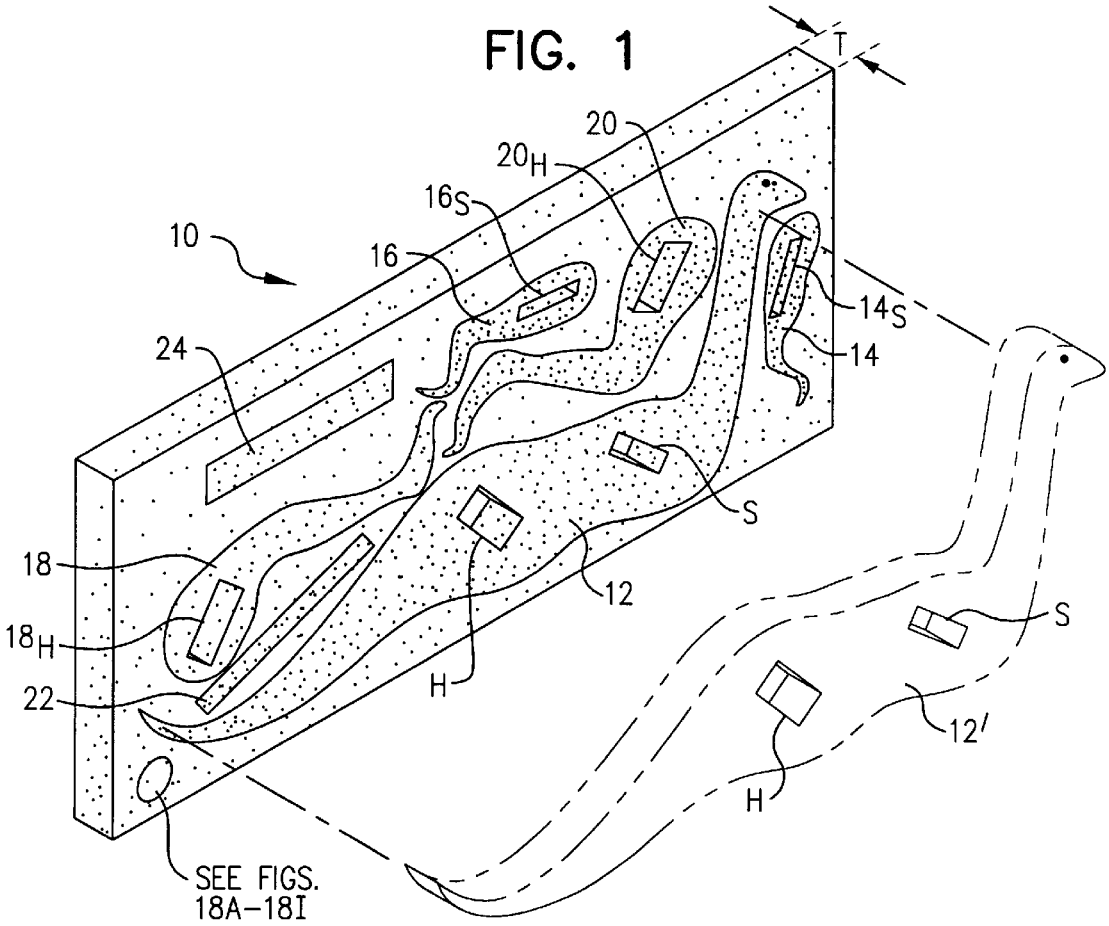
FIG. 1 is a perspective view of a foam animal, prepared according to the present invention, shown with all parts located in "puzzle" form in a form block from which the object is formed, and indicating in broken lines the removal of an integrally formed animal body section from the foam base.
Figure 3:
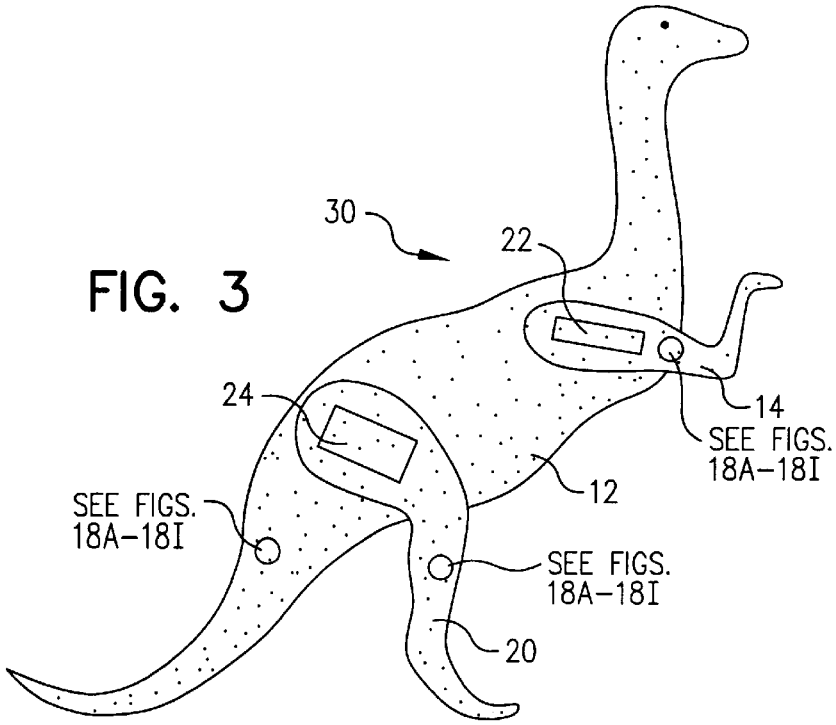
FIG. 3 is a side view of the foam animal, similar to that first depicted in FIG. 2, with now illustrating a one-piece body for the animal, and also illustrating front and rear limb pairs fixedly attached at hip and shoulder locations.

Attention is directed to FIG. 1 of the drawing, where a resilient foam puzzle block 10 is shown. Block 10, nominally of about one-half inch in thickness T, has a plurality of parts removably located therein. As shown, such parts include an elongated, flexible animal body 12, a pair of flexible animal arms 14 and 16, a pair of flexible animal legs 18 and 20, a fixed type shoulder pin 22, and a fixed type hip pin 24. Assembly of the parts into a foam animal is started by detaching the body 12 from block 10 as shown in hidden lines in FIG. 1 as body 12'. Then, the fixed type hip pin 24 is detached from block 10 and inserted in the body 12 at complementary sized hip aperture H, in a manner similar to that indicated in FIG. 2. Next, the fixed type shoulder pin 22 is removed from block 10 and inserted into body 12 at complementary sized shoulder aperture S. Finally, flexible animal legs 18 and 20 are attached to hip pin 24 on laterally opposing sides of body 12. Similarly, flexible animal arms 14 and 16 are attached to shoulder pin 22 on laterally opposing sides of body 12. Where fixed type hip pins 24 and fixed type shoulder pins 22 are utilized, I prefer to utilize a parallepiped type shape for each of pins 22 and 24. More preferably, an elongated, rectangular shape is utilized for such pins. Regardless, it is important that the hip socket aperture H and the shoulder socket aperture S in body 12 are of complementary size and shape to the shoulder pin 22 and the hip pin 24, respectively, Likewise, apertures $\mathbf{14}_S$ and $\mathbf{16}_S$ are provided in arms 14 and 16, respectively, and apertures $\mathbf{18}_H$ and $\mathbf{20}_H$ are provided in legs 18 and 20, respectively, each of size and shape to accommodate the respective shoulder pin 22 or hip pin 24. One embodiment of a final, fully assembled animal 30 is shown in FIG. 3, where a fully assembled dinosaur is provided.

Figure 2:
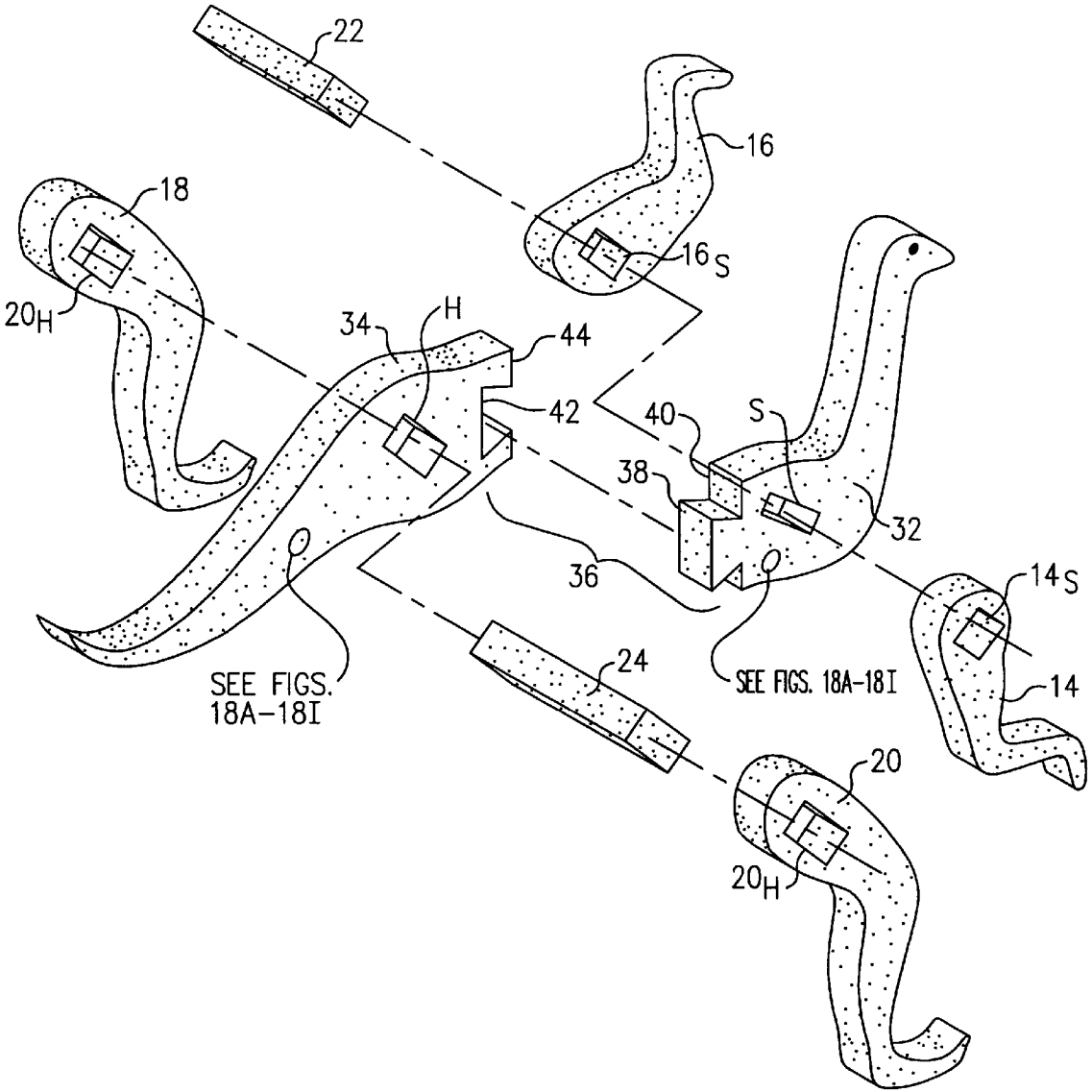
FIG. 2 is a perspective view which illustrates one method of assembly of a foam animal, where first and second body portions are assembled at an interlocking joint, and where front and rear pairs of flexible legs are attached on either side of a fixed type pin which extends through, and protrudes transversly from, the first and second body portions, respectively.

Kids often find it fun to "mix-and-match" animal body portions, and one structure which lends itself to such practices is illustrated in FIG. 2. A first body portion 32 and a second body portion 34 are provided. An interlocking joint 36 is provided between first body portion 32 and second body portion 34, preferably utilizing a "dove-tail" type of interlocking pattern, where an outwardly expanding wedge shaped tail 38 is provided at the rear 40 of first body portion 32, and where a complementary outwardly expanding receiving aperture 42 is provided at the front portion 44 of the second body portion 34. However, any convenient detachably interlocking joint would be suitable for interlocking the first body portion 32 and the second body portion 34.

Figure 4:
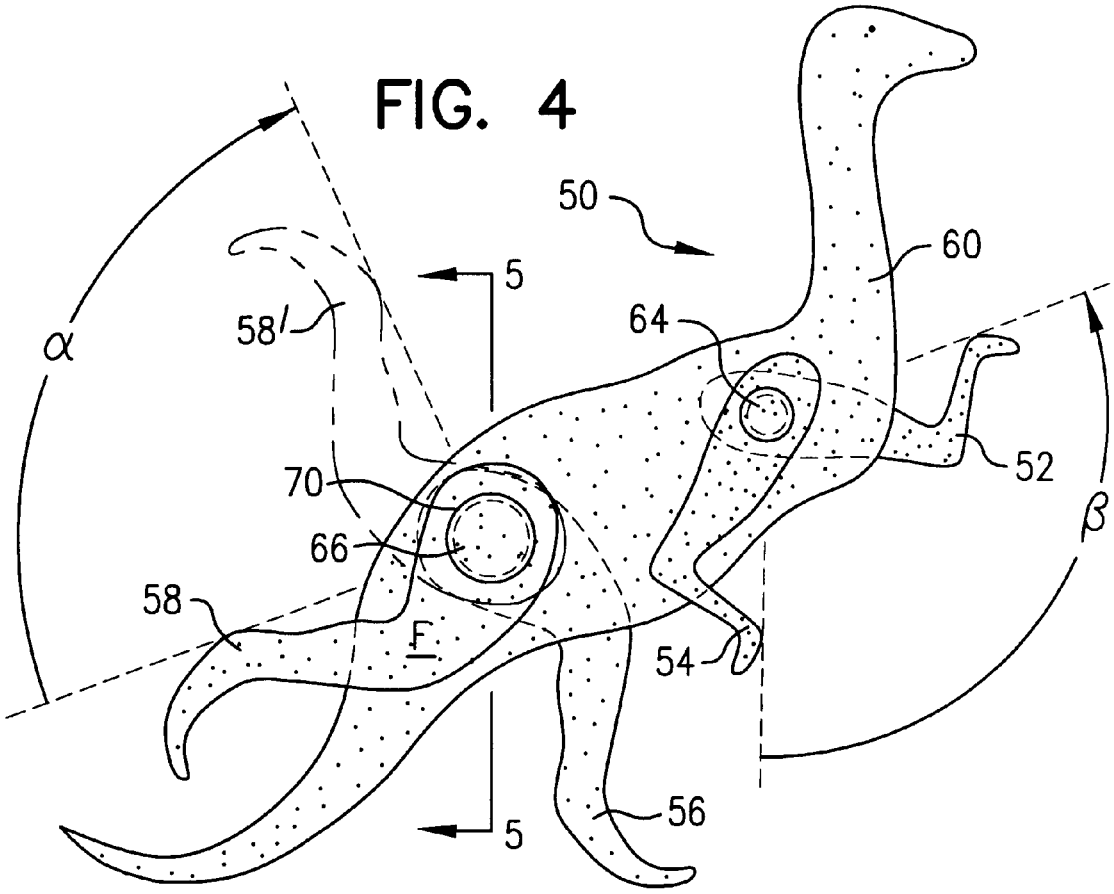
FIG. 4 is a side view a foam animal similar to that first depicted in FIG. 3 above, but now showing a one-piece body for the animal with front and rear pairs of articulating limbs that are attached to round pivot dowels that are inserted in the body at hip and shoulder locations.
Figure 5:
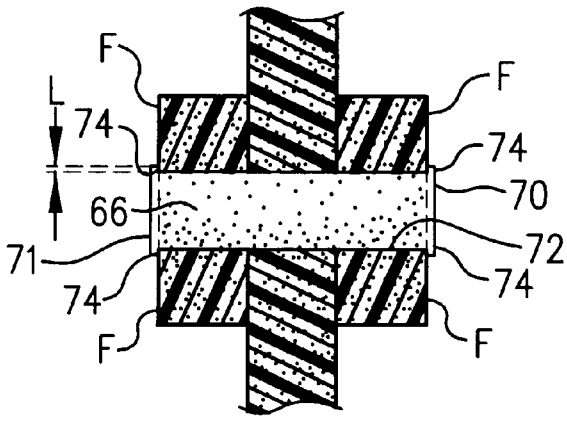
FIG. 5 is a partial cross-sectional view of an animal body at a joint location, taken through a pivot dowel, showing the flexible integral end cap on each end of the pivot dowel which releasably secures the limbs to the pivot.

To increase enjoyment and "action" potential in interactive use of my resilient foam animal designs, I have found it desirable to provide a resilient foam animal 50 which has pivotable front limbs 52 and 54, and pivotable rear limbs 56 and 58, as is shown in FIGS. 4 and 5. In such a design, it can seen that, for example, a rear limb 58 could be pivoted by an angle alpha ($\alpha$) to the position indicated as 58'. Likewise, front limbs 52 and 54 could be pivoted by an angle beta ($\beta$), such as the angle shown between front limb 52 and front limb 54. Preferably, there is no limit on either angle alpha ($\alpha$) or on angle beta ($\beta$), and either of front limbs 52 and 54, and either of rear limbs 56 and 58, can be rotated a full three hundred sixty (360) degrees.

As better understood from study of FIG. 5, for securing front limbs 52 and 54 or for securing rear limbs 56 and 58 to the body 60, I have found it advantageous to use round foam dowels with integral caps as hip pins 66, as well as for the similar shoulder pins 64. In FIG. 5, an integrally capped round dowel pin, such as hip pin 66, is illustrated in cross-section. Both of the integrally provided caps 70 and 71 extend radially outward from the cylindrical surface 72 of pin 66 by a small pre-selected distance L, so that an inward surface 74 of cap 70 or 71 provides a retaining force against the outer surface face F of a selected limb, whether it be rear limbs 56 and 58 as shown in FIG. 5, or the front limbs 52 and 54.

Figure 6:
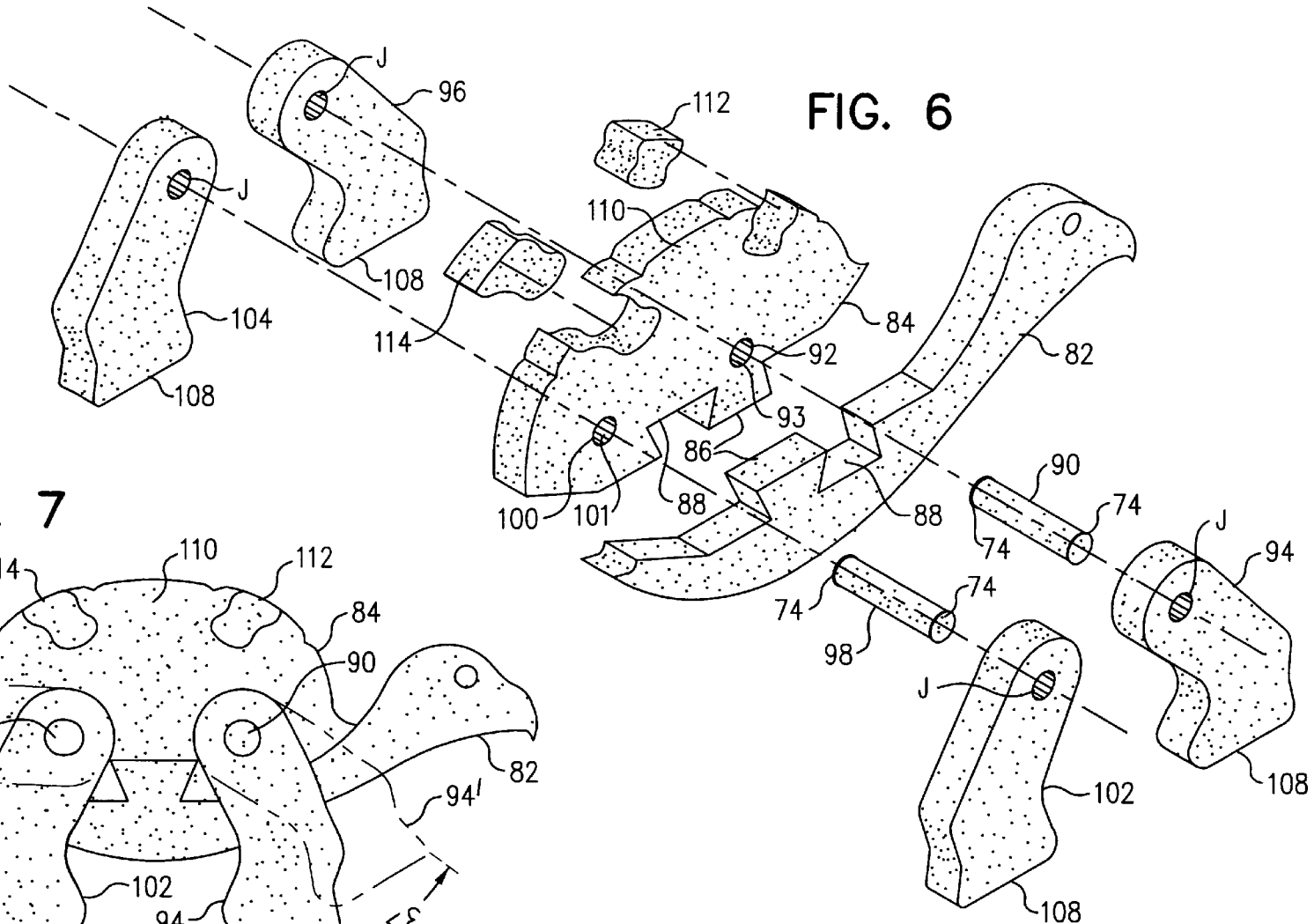
FIG. 6 is a an exploded perspective view which illustrates one method of assembly of a foam animal, where first and second body portions are assembled at a substantially horizontally oriented interlocking joint, and where front and rear pairs of flexible legs are attached on either side of an articulating pivot pin which extends through, and protrudes transversly from, the first and second body portions, respectively.
Figure 7:
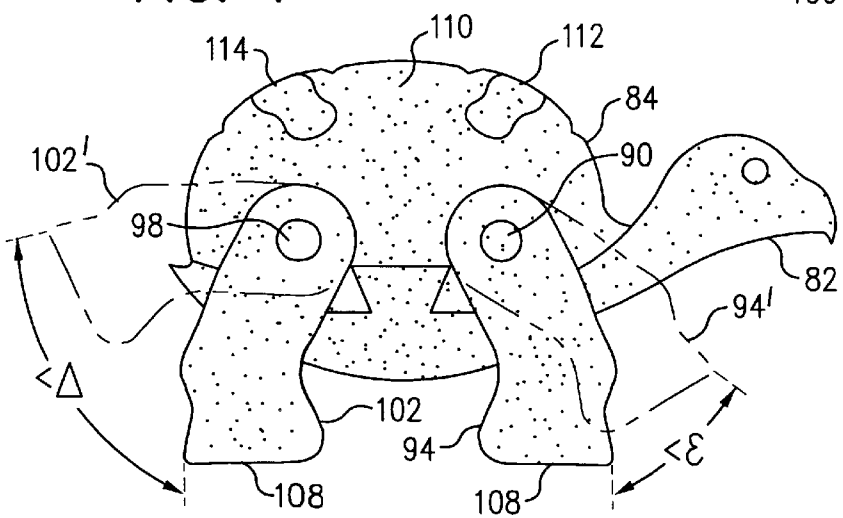
FIG. 7 is side view of the assembled foam animal just depicted in FIG. 6, now showing the animal with all parts fully assembled, and indicating in broken lines the alternate position, after movement by pivoting, of the front and rear legs.

Turning now to FIG. 6, a foam turtle 80 with a two-piece body is provided. A first body portion 82 and a second body or shell portion 84 are interlocked at a substantially horizontally oriented joint, using a dove-tail wedge 86 and a complementary wedge shaped aperture 88, similar that described in FIG. 2 above. A shoulder pivot pin 90 is placed through shoulder socket aperture 92 (defined by wall 93), and a first pair of limbs 94 and 96 are attached thereto, and retained thereon, in the manner depicted in FIG. 5 and just described above. Similarly, a hip pivot pin 98 is placed through hip socket aperture 100 (defined by wall 101), and second pair of limbs 102 and 104 are attached thereto, and retained thereon in the manner depicted in FIG. 5. Motion is allowed in the front limbs 94 and 96, and in the rear limbs 102 and 104, as indicated in FIG. 7. In FIG. 7, a repositioned front limb 94 is shown in broken lines displaced by an angle epsilon ($\epsilon$) to a position 94', and where a repositioned rear limb 102 is shown in broken lines displaced by an angle delta ($\Delta$) to a position 102'. In each of the limbs 94, 96, 102, and 104, joint apertures J are provided for attachment of the relevant shoulder or hip pivot pins 90 and 98, respectively. Also, in this embodiment, flat foot portions 108 are provided for each of limbs. Additionally, to provide a surface pattern for shell 110, interlocking shell portions 112 and 114 are provided to interfittingly lock into the second body or shell portion 84.

Figure 8A:
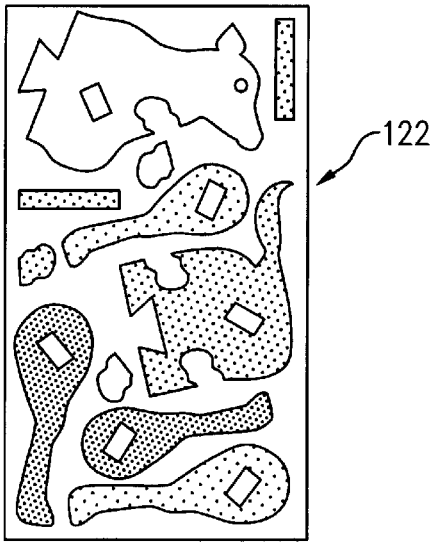
FIG. 8A is yet another embodiment for a foam animal cow, shown in the unassembled puzzle form, where parts are provided in multiple colors.
Figure 8B:
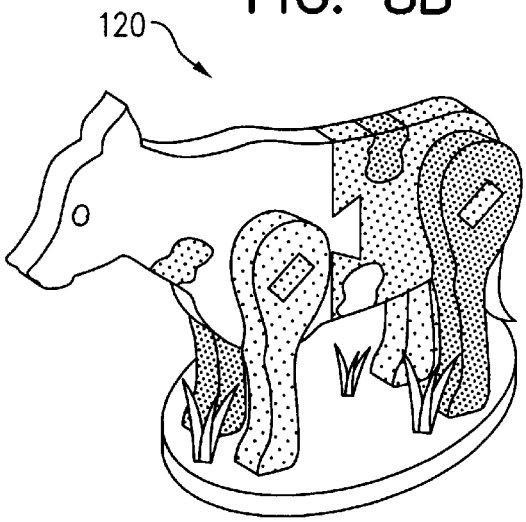
FIG. 8B is the embodiment just illustrated in FIG. 8A above, now showing a perspective view of a fully assembled foam cow.
Figure 8C:
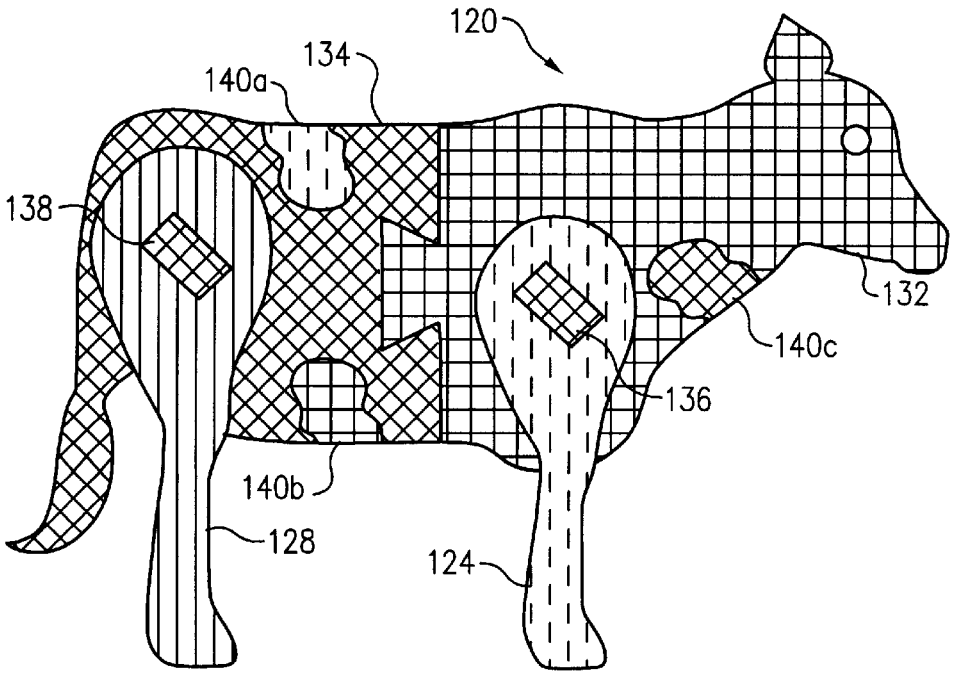
FIG. 8C again illustrates the embodiment first shown in FIGS. 8A and 8B, now showing a side view of a fully assembled foam cow, more clearly illustrating the provision of various color foam parts.
Figure 8D:
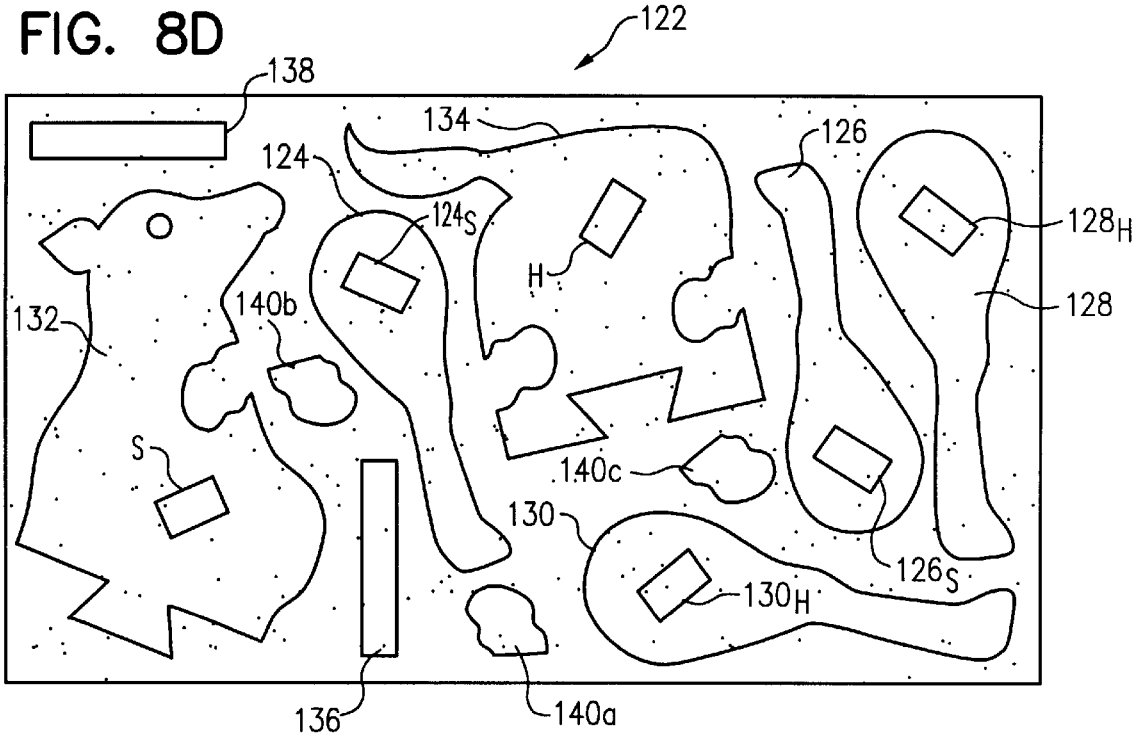
FIG. 8D is yet another view of the foam animal cow in the unassembled puzzle form.

Turning now to FIGS. 8A, 8B, 8C, and 8D, yet another embodiment of my invention is depicted. Here, a foam cow is 120 is shown in unassembled form in a foam block puzzle 122, in FIGS. 8A and 8D. In FIG. 8B, a perspective view of an assembled foam cow 120 is provided. In FIG. 8C, a side view of a fully assembled cow 120 is provided, and this figure is shaded for color of one preferred version of the foam cow 120. As is evident in FIG. 8D, front legs 124 and 126, and rear legs 128 and 130 are provided. A head portion 132 is provided, and a rear body portion 134 is provided. Front legs 124 and 126 are affixed to head portion 132 via shoulder pin 136. Rear legs 128 and 130 are affixed to the rear body portion 134 via hip pin 138, in the manner described above. Subscripts "S" and "H" are used in conjunction with numbering for front and rear legs to denote apertures for shoulder and hip joints, respectively, in the applicable front and rear legs. In addition, color patches $\mathbf{140}_a$, $\mathbf{140}_b$, and $\mathbf{140}_c$ are provided to enhance the visual appearance of the foam cow 120.

Figure 9A:
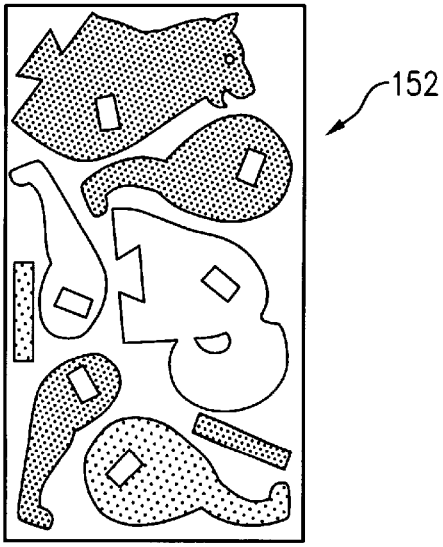
FIG. 9A is yet another embodiment for a foam animal dog, shown in the unassembled puzzle form, where parts are provided in multiple colors.
Figure 9B:
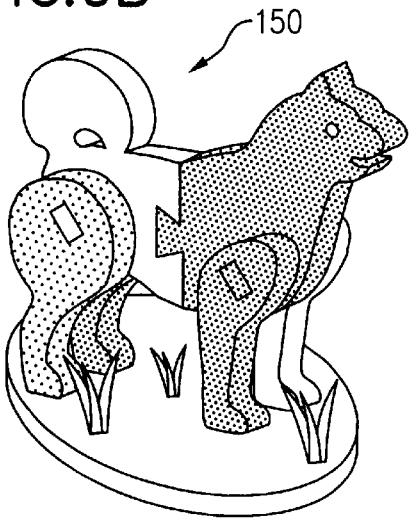
FIG. 9B is the embodiment just illustrated in FIG. 9A above, now showing a perspective view of a fully assembled foam dog.
Figure 9C:
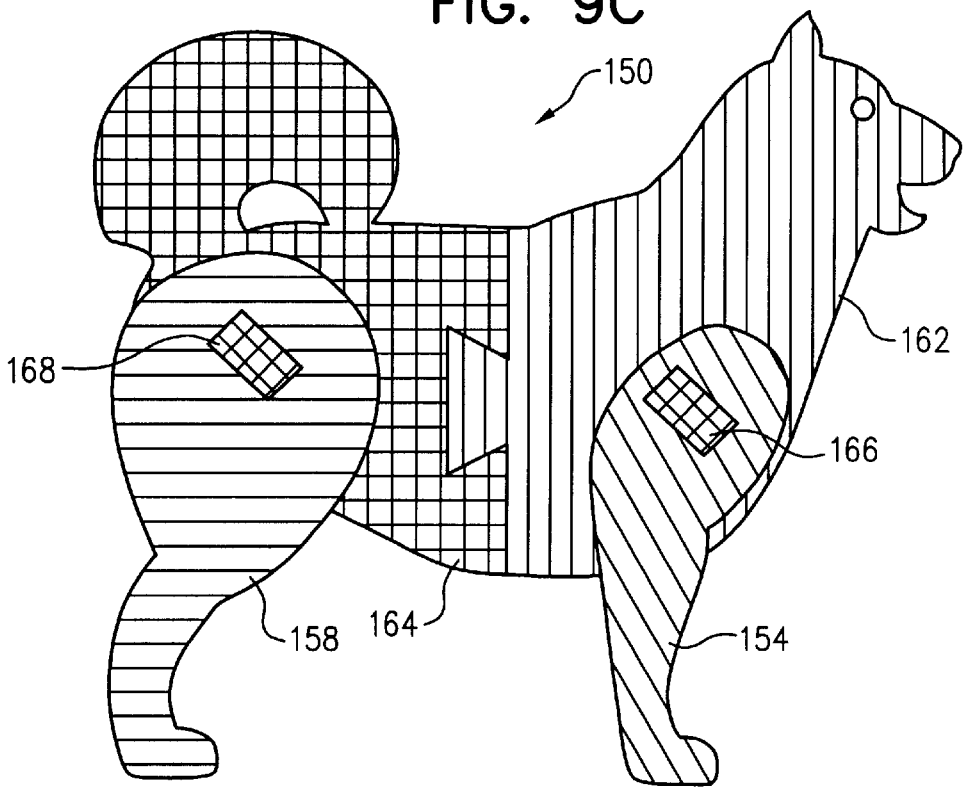
FIG. 9C again illustrates the embodiment first shown in FIGS. 9A and 9B, now showing a side view of a fully assembled foam dog, more clearly illustrating the provision of various color foam parts.
Figure 9D:
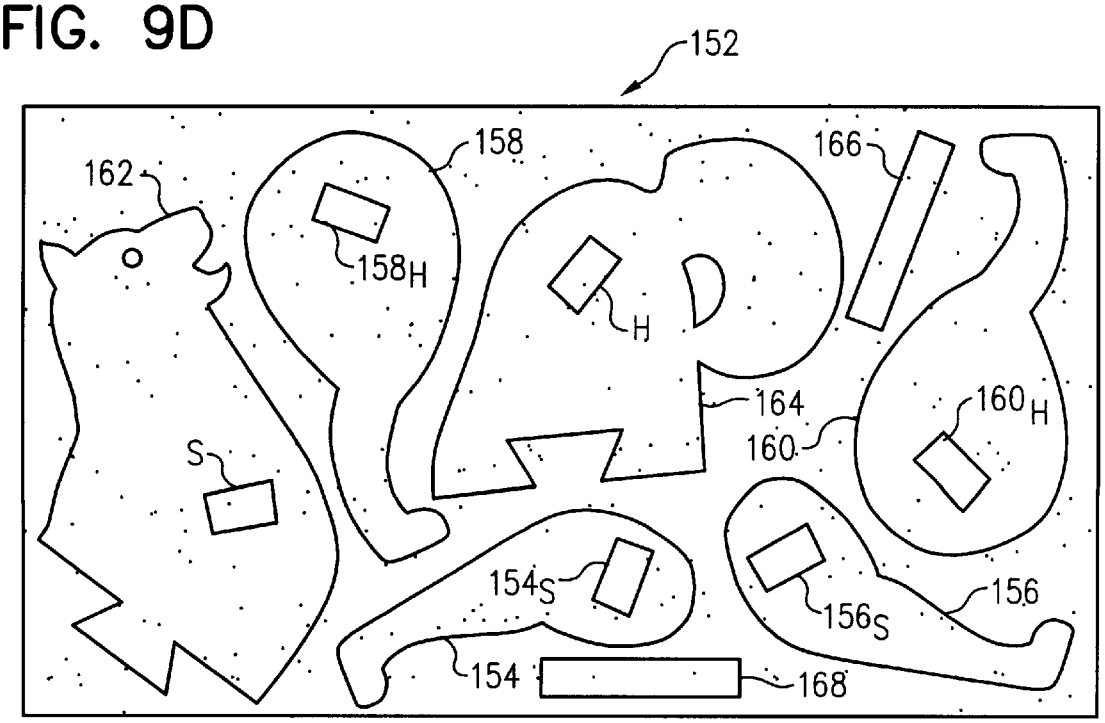
FIG. 9D is yet another view of the foam animal dog in the unassembled puzzle form.

FIGS. 9A, 9B, 9C, and 9D, depict yet another embodiment of my invention, similar in concept to that just described in FIGS. 8A, 8B, 8C, and 8D. Now, a foam dog is 150 is shown in unassembled form in a foam block puzzle 152, in FIGS. 9A and 9D. In FIG. 9B, a perspective view of dog 150 is provided. In FIG. 9C, a side view of a fully assembled dog is provided, and this figure is shaded for color of one preferred version of the foam dog. As is evident in FIG. 9D, front legs 154 and 156, and rear legs 158 and 160 are provided. A head portion 162 is provided, and a rear body portion 164 is provided. Front legs 154 and 156 are affixed to head portion 162 via shoulder pin 166. Rear legs 158 and 160 are affixed to the rear body portion 164 via hip pin 168, in the manner described above. Subscripts "S" and "H" are used in conjunction with numbering for front and rear legs to denote apertures for shoulder and hip joints, respectively, in the applicable front and rear legs.

Figure 10A:
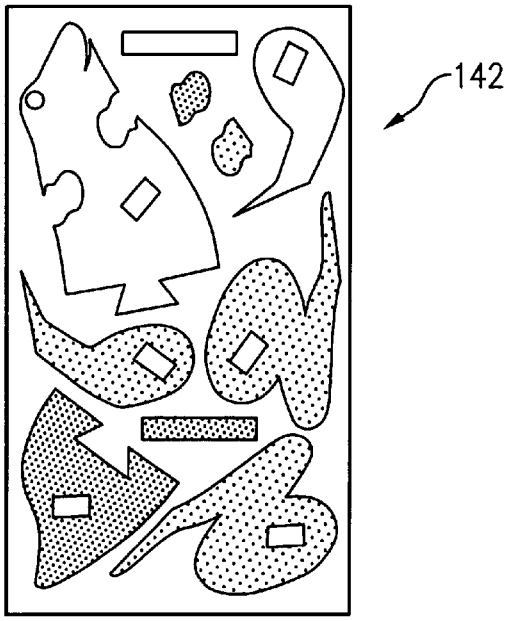
FIG. 10A is yet another embodiment for a foam frog, shown in the unassembled puzzle form, where parts are provided in multiple colors.
Figure 10B:
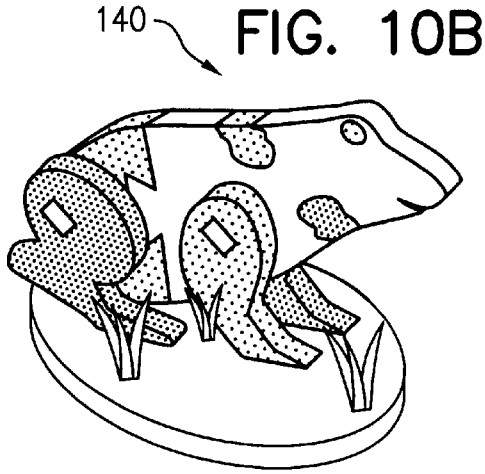
FIG. 10B is the embodiment just illustrated in FIG. 10A above, now showing a perspective view of a fully assembled foam frog.
Figure 10C:
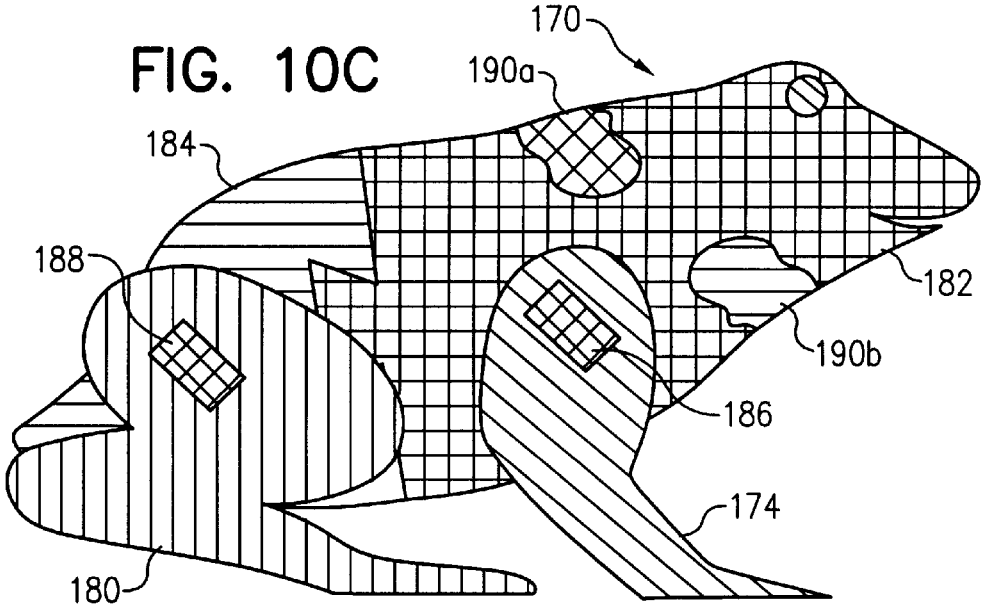
FIG. 10C again illustrates the embodiment first shown in FIGS. 10A and 10B now showing a side view of a fully assembled foam frog, more clearly illustrating the provision of various color foam parts.
Figure 10D:
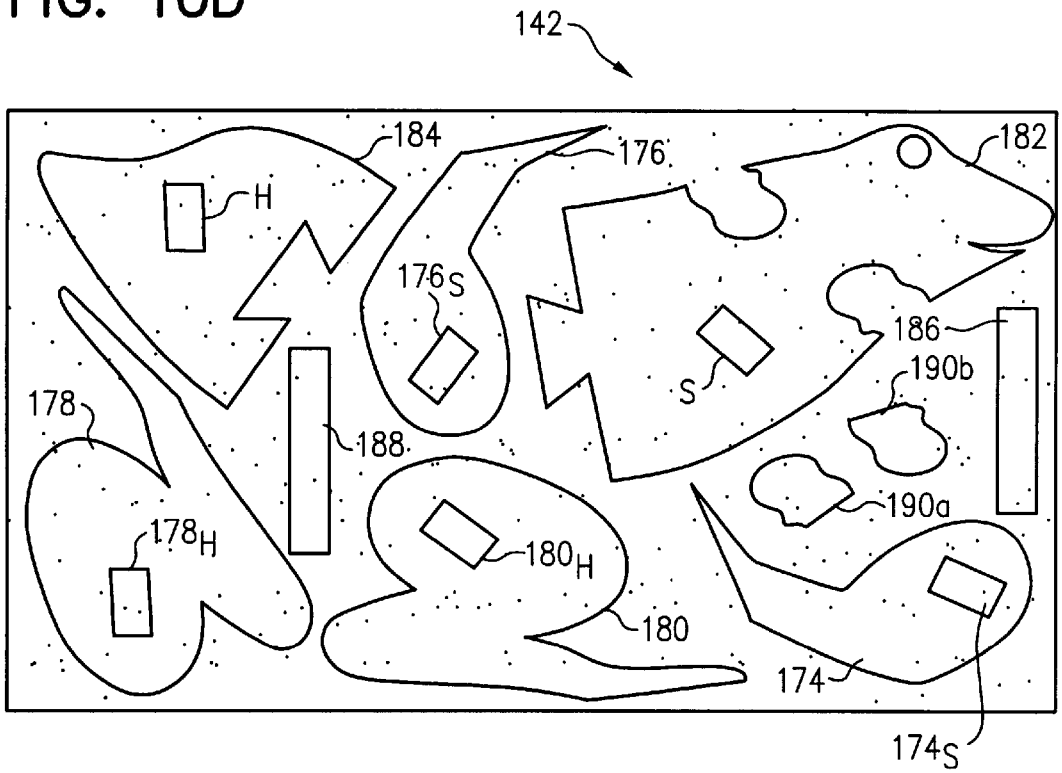
FIG. 10D is yet another view of the foam animal frog in the unassembled puzzle form.

FIGS. 10A, 10B, 10C, and 10D, depict yet another embodiment of my invention, similar in concept to that just described in FIGS. 9A, 9B, 9C, and 9D. Now, a foam frog is 170 is shown in unassembled form in a foam block puzzle 172, in FIGS. 10A and 10D. In FIG. 10B, a perspective view of frog 170 is provided. In FIG. 10C, a side view of a fully assembled dog is provided, and this figure is shaded for color of one preferred version of the foam dog. As is evident in FIG. 10D, front legs 174 and 176, and rear legs 178 and 180 are provided. A head portion 182 is provided, and a rear body portion 184 is provided. Front legs 174 and 176 are affixed to head portion 182 via shoulder pin 186. Rear legs 178 and 180 are affixed to the rear body portion 184 via hip pin 188, in the manner described above. Subscripts "S" and "H" are used in conjunction with numbering for front and rear legs to denote apertures for shoulder and hip joints, respectively, in the applicable front and rear legs. In addition, color patches $\mathbf{190}_a$, and $\mathbf{190}_b$ are provided to enhance the visual appearance of the foam frog 170.

As illustrated, the animals shown in FIGS. 8C, 9C, 10C and related figures utilize fixed limbs similar to the structure first set forth in FIGS. 1 and 2 above, however, it should be understood that these foam animal designs can also be fabricated using the articulating limb structures, either as earlier described with reference to FIGS. 4 and 5, or as described below with reference to the use of differential friction cutout joint sockets to allow repositionable articulation of limbs.

Figure 11:
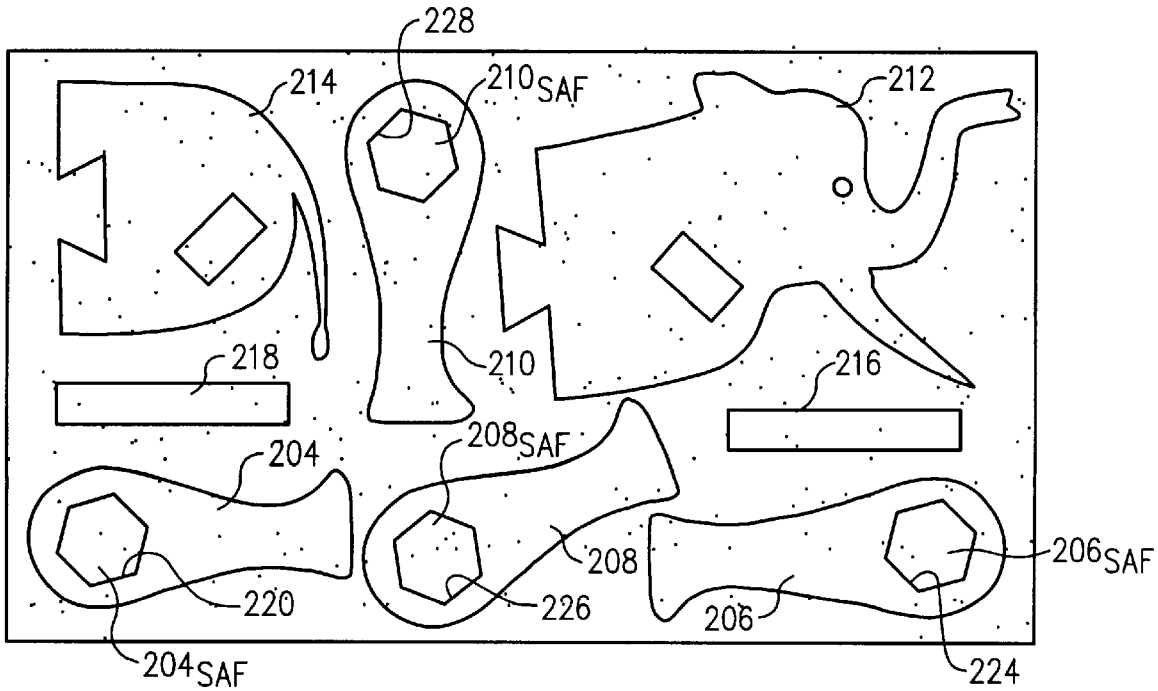
FIG. 11 again illustrates another embodiment, similar to that shown in FIGS. 8D, 9D, and 10D, now showing an elephant in the unassembled puzzle form.
Figure 12:
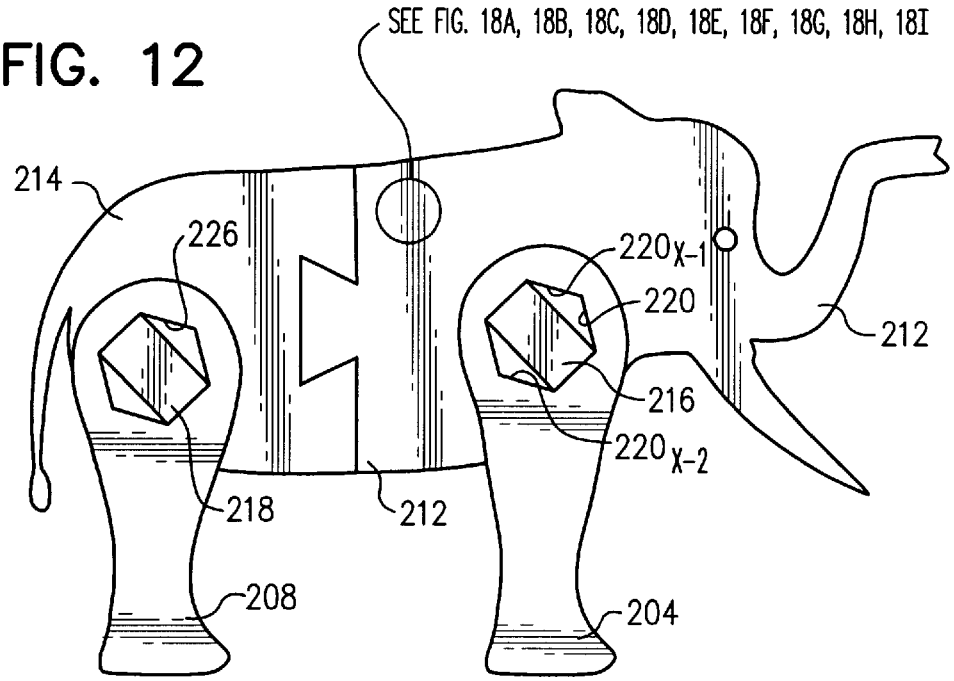
FIG. 12 illustrates the embodiment first shown in FIG. 11, now illustrating the side view of a fully assembled foam elephant, also illustrating the use of hexagonal or hex-socket shaped cutouts in leg members to allow adjustable positioning of leg members.

Turning now to FIGS. 11–14, two additional embodiments are provided to illustrate the use of a differential friction cutout joint socket that allows the repositionable articulation of a rotatable part such as a limb. First, in FIG. 11, a foam elephant 200 is shown in unassembled form in a foam block puzzle 202. In FIG. 12, a side view of a fully assembled foam elephant 200 is provided. As is evident in FIG. 12, front legs 204 and 206, and rear legs 208 and 210 are provided. A head portion 212 is provided, and a rear body portion 214 is provided. Front legs 204 and 206 are affixed to head portion 212 via shoulder pin 216. Rear legs 208 and 210 are affixed to the rear body portion 214 via hip pin 218. Subscripts "SAF" and "HAF" are used in conjunction with numbering for front and rear legs to denote the unique articulating friction apertures for shoulder and hip joints, respectively, in the applicable front and rear legs. Note that the front leg aperture $\mathbf{204}_{SAF}$ is defined by an interior, hex-socket shaped wall 220 against which the rectangular end 222 of shoulder pin 216 frictionally engages. Both the wall 220 and the shoulder pin 216 are sufficiently deformable that the front leg 204 may be turned, and then repositioned at a new location corresponding to new, preferably opposing wall portions $\mathbf{220}_{x\text{-}1}$ and $\mathbf{220}_{x\text{-}2}$ of the interior socket-shaped wall of the front leg aperture $\mathbf{204}_{SAF}$. Similarly, interior, hex-socket shaped wall 224 is provided in the other front leg 206, and hex-socket shaped walls 226 and 228 are provided in the rear legs 208 and 210, respectively.

Although the elephant 200 shown in FIGS. 11 and 12 is not shaded for color, any of the parts may be manufactured in any desired and available color foam, as indicated by the reference to FIGS. 18A through 18I, which represent alternate colors for the body of the foam elephant 200, as shown in FIG. 11. Moreover, any one of the parts of the embodiments illustrated herein, or alternate embodiments built in accord with the teachings hereof, or the legal equivalents thereof, may be manufactured in any of the alternate colors selected from those illustrated in FIGS. 18A through 18I.

Figure 13:
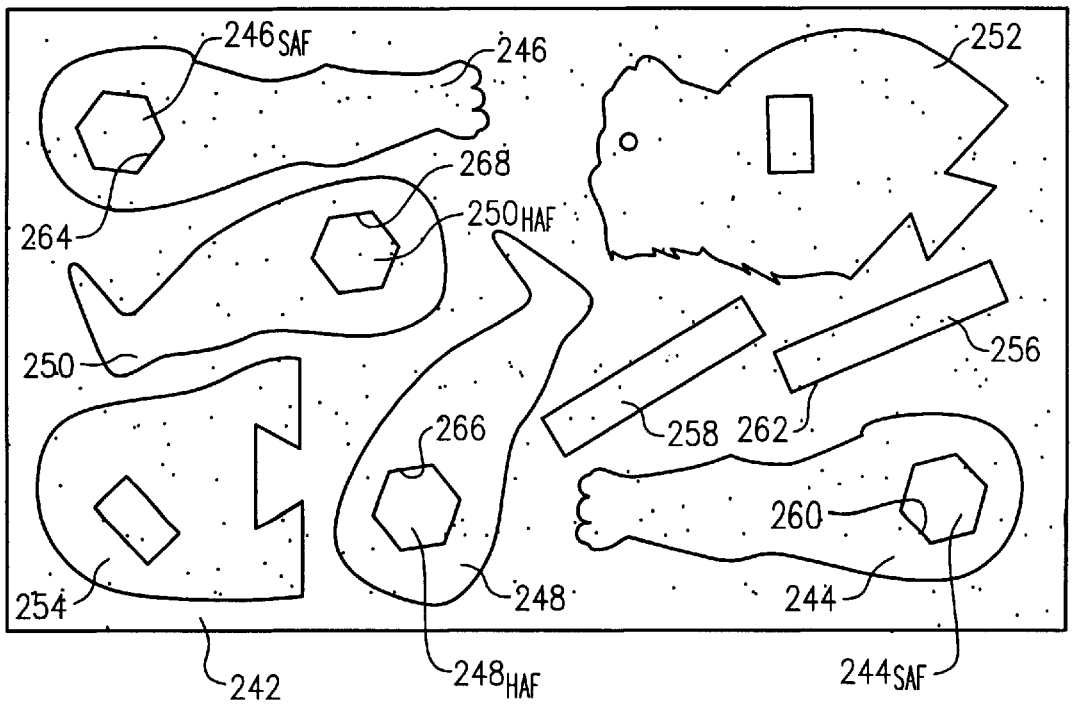
FIG. 13 illustrates yet another embodiment, similar to that shown in FIGS. 8D, 9D, 10D, and 11, now showing a gorilla in the unassembled puzzle form.
Figure 14:
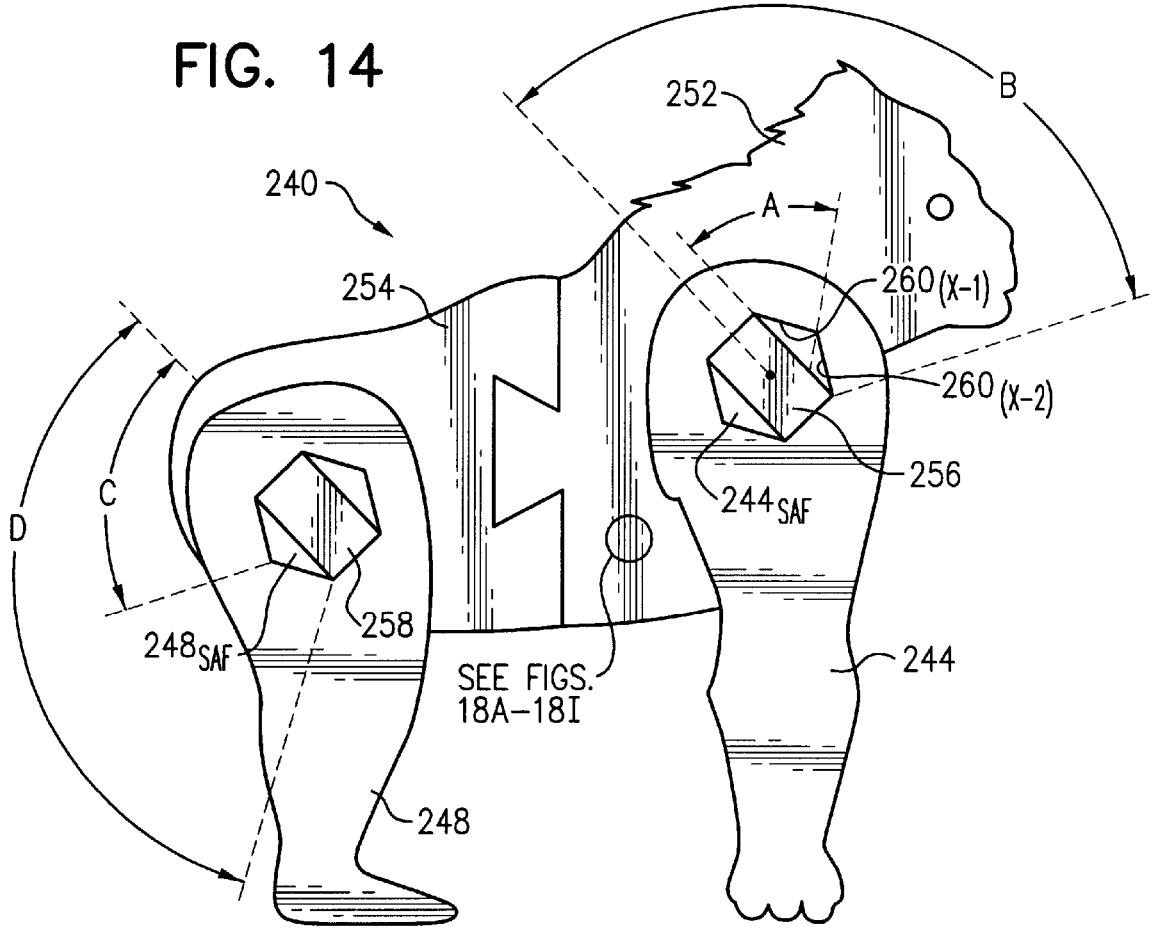
FIG. 14 illustrates the embodiment first shown in FIG. 13, now illustrating the side view of a fully assembled foam gorilla, and also illustrating the use of hexagonal or hex-socket shaped cutouts in leg members to allow adjustable positioning of leg members.

The differential friction cutout joint socket that allows the repositionable articulation of a rotatable part such as a limb is further depicted in FIGS. 13 and 14, where a foam gorilla 240 is depicted. In FIG. 13, the foam gorilla 240 is shown in unassembled form in a foam block puzzle 242. In FIG. 14, a side view of a fully assembled foam gorilla 240 is provided. As is evident in FIG. 13, front legs 244 and 246, and rear legs 248 and 250 are provided. A head portion 252 is provided, and a rear body portion 254 is provided. Front legs 244 and 246 are affixed to head portion 252 via shoulder pin 256. Rear legs 248 and 250 are affixed to the rear body portion 254 via hip pin 258. Subscripts "SAF" and "HAF" are used in conjunction with numbering for front and rear legs to denote the unique articulating friction apertures for shoulder and hip joints, respectively, in the applicable front and rear legs. Note that the front leg aperture $\mathbf{244}_{SAF}$ is defined by an interior, hex-socket shaped wall 260 against which the rectangular end 262 of shoulder pin 256 frictionally engages. Both the wall 260 and the shoulder pin 256 are sufficiently deformable that the front leg 244 may be turned, and then repositioned at a new location corresponding to new, preferably opposing wall portions $\mathbf{260}_{x\text{-}1}$ and $\mathbf{260}_{x\text{-}2}$ of the interior socket-shaped wall of the front leg aperture $\mathbf{244}_{SAF}$. To turn front leg 244 by an angle A, the rectangular end 266 of shoulder pin 256 is brought to bear against interior wall portion $\mathbf{260}_{x\text{-}1}$ of front leg 244. Likewise, to turn front leg 244 by an angle B, the rectangular end 266 of shoulder pin 256 is brought to bear against interior wall portion $\mathbf{260}_{x\text{-}2}$ of of front leg 244. Similarly, interior, hex-socket shaped wall 264 is provided in the other front leg 246, and hex-socket shaped walls 266 and 268 are provided in the rear legs 248 and 250, respectively. As now thoroughly illustrated, appendages such as legs 244 and 248 can be articulated about a shoulder pin 256, for easy manipulation. Similar structures are provided in other appendages.

Figure 15:
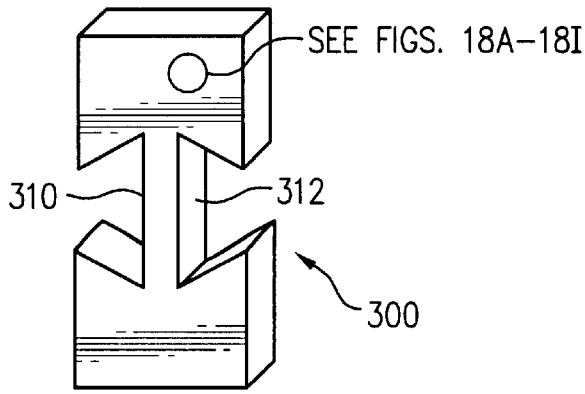
FIG. 15 shows a universal adaptor, designed for joining any selected pair of first parts (which have male dove tail joints) together.
Figure 16:
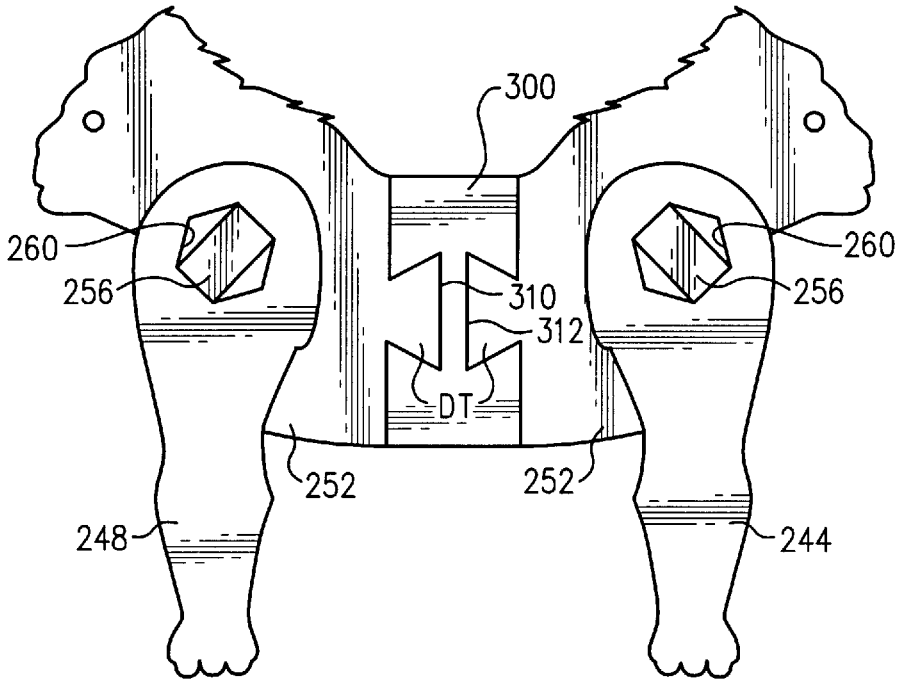
FIG. 16 shows the use of the universal adaptor (just illustrated in FIG. 15 above) for joining a pair of gorilla head portions together to form a "double gorilla" foam animal toy.

Turning now to FIG. 15, a unique mating joint 300 is illustrated. The joint is preferably generally H-shaped, and configured with angular wing portions to lockingly accept, on each of opposing sides 310 and 312, a wedged shaped or dove tail element DT. Thus, a first element (here gorilla head portion 252) which includes a dove tail DT, can be joined by the use of mating joint 300 with a second element (here a second gorilla head portion 252) which includes a dove tail DT. Generally, this type of interlocking joint has been already described above.

Figure 17:
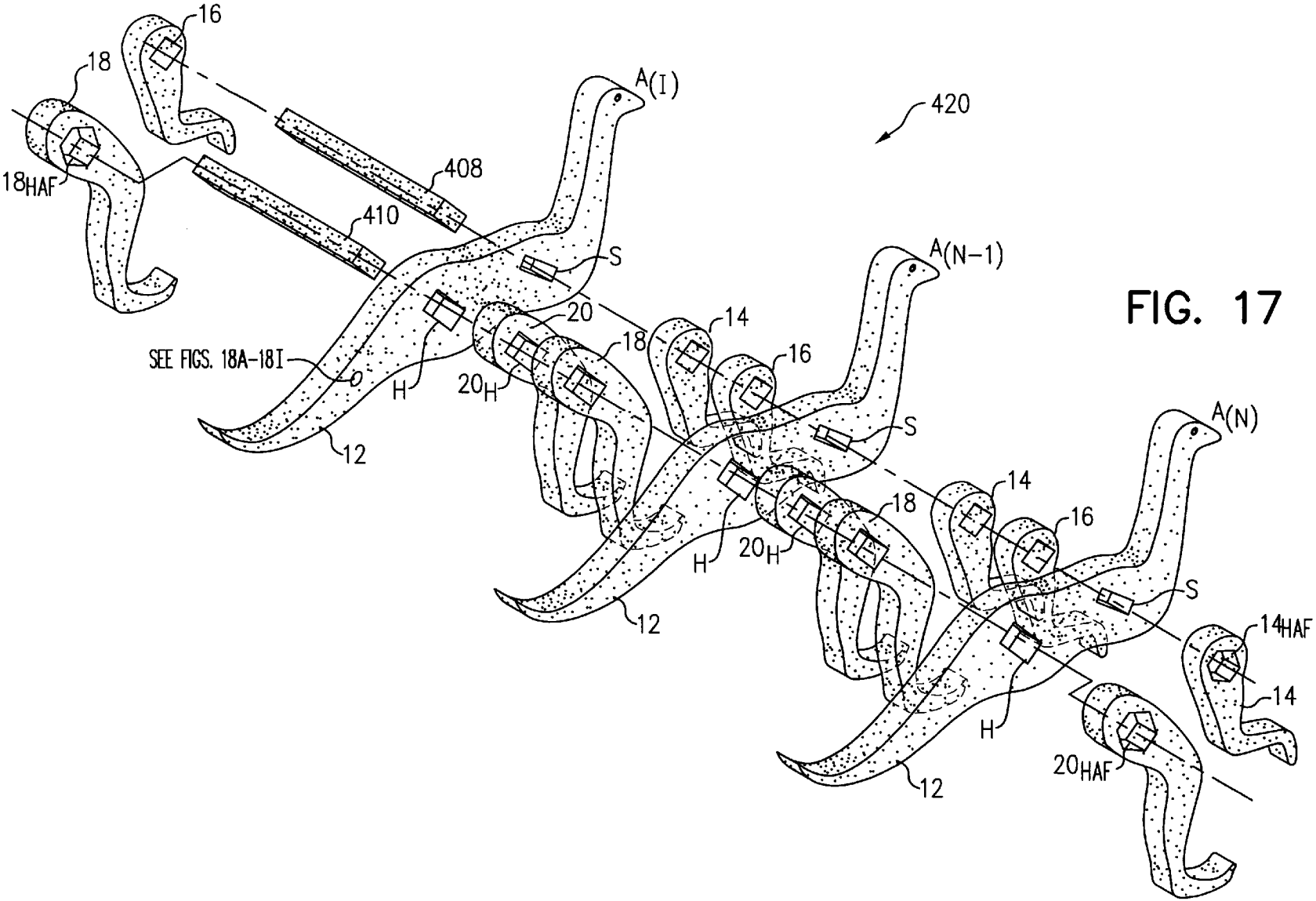
FIG. 17 shows the use of extended shoulder pins and hip pins to assemble foam animals into multiple animal groups; here, the length of extended shoulder and hip pins allows a triple dinosaur group to be assembled on a pair of common hip and shoulder pins.

Finally, it is interesting to children to join a plurality of "n" foam animals A in a series $A_1$, $A_{(n-1)}$, through $A_n$. As shown in FIG. 17, n=3, and extended shoulder pins 408 and extended hip pins 410 are provided to extend through the preselected number n of animals A, in order to hold the plurality of animals A together, as well as allow attachment of front legs thereto, in either a fixed or an articulating manner. When fully assembled, as illustrated, a triple dinosaur 420 results.

I prefer to build the foam animals or other resilient foam objects in a high strength foam, such as an EVA (ethylene vinyl acetate) or neoprene type foam. However, a variety of suitable materials may be selected for particular designs, without departing from the spirit and details of my invention. It is a fundamental and important quality of my invention that in the preferred embodiment, the foam animals are composed of material which provides a resilient, springing return to the original shape and size after being crushed by hand. Also, the combination of the materials of construction and the long, flexible limb design lends itself to allowing the animal to "jump" when the limbs, particularly rear limbs 56 and 58, for example, are deformed against a flat surface and then released.

It is to be appreciated that the novel puzzles, and the resilient foam animals provided by the present invention are a novel and interesting development in the toy manufacturing industry. My novel foam products are relatively simple, and without much cost and complexity, a unique educational toy is provided.

It is thus clear from the heretofore provided description that my novel resilient foam toys, as described and disclosed herein, are an appreciable improvement in the state of the art of resilient toys. Although only a few exemplary embodiments of this invention have been described in detail, it will be readily apparent to those skilled in the art that the my novel resilient foam toy animals, or other foam toy objects, may be modified from those embodiments provided without materially departing from the novel teachings and advantages provided by this invention, and may be embodied in other specific forms without departing from the spirit or essential characteristics thereof. Therefore, the embodiments presented herein are to be considered in all respects as illustrative and not restrictive. As such, the claims are intended to cover the structures described herein, and not only structural equivalents thereof, but also equivalent structures. Thus, the scope of the invention is intended to include variations from the embodiments provided which are nevertheless described by the broad meaning and range properly afforded to the language set forth herein, or to the equivalents thereof.

I claim:

1. A foam animal toy, said foam animal toy comprised of a number of preselected separable pieces, said preselected separable pieces comprising:

at least one resilient foam body portion;

a pair of resilient foam front leg elements;

a pair of resilient foam rear leg elements;

a shoulder pin, said shoulder pin sized and shaped for detachably affixing said pair of front leg elements to said at least one resilient foam body portion, and wherein each one of said pair of front leg elements further comprises an aperture defined by plurality of wall portions, said aperture sized and shaped to securely and frictionally receive therein, in a releasably positionable fashion, said shoulder pin;

a hip pin, said hip pin sized and shaped for detachably affixing said pair of rear leg elements to said at least one resilient foam body portion, and wherein each one of said pair of rear leg elements further comprises an aperture defined by a plurality of wall portions, said aperture sized and shaped to securely and frictionally receive therein, in a releasably positionable fashion, said hip pin.

2. A multiple animal toy, said multiple animal toy comprising a plurality of foam animals A, said plurality described by a positive integral number n of said toys, said number n in a sequence of said toys $A_1$, $A_{n-1}$, . . . $A_n$, wherein (a) each of said foam animals A in said multiple foam animal toy comprises a number of preselected separable pieces, said preselected separable pieces comprising:

(i) at least one resilient foam body portion;

(ii) a pair of resilient foam front leg elements;

(ii) a pair of resilient foam rear leg elements;

(b) an elongated shoulder pin, said elongated shoulder pin sized and shaped to detachably affix n pairs of front leg elements to a number n of said at least one resilient foam body portions; and (c) an elongated hip pin, said elongated hip pin sized and shaped to detachably affix n pairs of rear leg elements to a number n of said at least one resilient foam body portions.

3. The toy as set forth in claim 1, or in claim 2, wherein each foam animal toy further comprises at least two resilient foam body portions.

4. The foam animal toy as set forth in claim 3, wherein each of said at least two resilient foam body portions are detachably affixable, each to the other.

5. The foam animal toy as set forth in claim 2, wherein said shoulder pin comprises an elongated, substantially cylindrical dowel.

6. The foam animal toy as set forth in claim 5, wherein said shoulder pin further comprises, on at least one end thereof, a transversely extending retaining lip.

7. The foam animal toy as set forth in claim 6, wherein said transversely extending retaining lip comprises an annular shaped retaining ring extending radially outward from the circular surface of said dowel.

8. The foam animal toy as set forth in claim 7, wherein said annular shaped retaining ring is integrally formed with and as a part of said shoulder pin.

9. The foam animal toy as set forth in claim 2, wherein said hip pin comprises an elongated, substantially cylindrical dowel.

10. The foam animal toy as set forth in claim 9, wherein said hip pin further comprises, on at least one end thereof, a transversely extending retaining lip.

11. The foam animal toy as set forth in claim 10, wherein said transversely extending retaining lip comprises an annular shaped retaining ring extending radially outward from the circular surface of said dowel.

12. The foam animal toy as set forth in claim 11, wherein said annular shaped retaining ring is integrally formed with and as a part of said hip pin.

13. The foam animal toy as set forth in claim 1, or in claim 2, wherein said pair of front legs further comprises a hex-socket shaped aperture defined by a wall edge portion, said aperture sized and shaped to securely and frictionally receive therein, in releasably positionable fashion, said shoulder pin.

14. The foam animal toy as set forth in claim 1, or in claim 2, wherein said pair of rear legs further comprises a hex-socket shaped aperture defined by a wall edge portion, said aperture sized and shaped to securely and frictionally receive therein, in releasably positionable fashion, said hip pin.

15. The foam animal toy as set forth in claim 1, or in claim 2, wherein said foam animal toy has the property of crushable resilience, in that said toy reliably and repeatedly returns to its original shape upon release of a deforming crushing force imparted thereon which visibly moves the parts thereof.

16. The apparatus as set forth in claim 1, or in claim 2, wherein said apparatus comprises an ethylene vinyl acetate type foam.

17. The apparatus as set forth in claim 1, or in claim 2, wherein said resilient foam comprises a color selected from one or more of the following:

(a) red or purple;

(b) brown;

(c) violet or purple (d) green;

(e) blue;

(f) gray or silver;

(g) orange;

(h) yellow or gold;

(i) black.

* * * * *

UNITED STATES PATENT AND TRADEMARK OFFICE

CERTIFICATE OF CORRECTION

PATENT NO. : 6,234,858 B1
DATED : May 22, 2001
INVENTOR(S) : Jon O. Nix

It is certified that error appears in the above-identified patent and that said Letters Patent is hereby corrected as shown below:

Title page,
Item [57], ABSTRACT,
Line 17, after the words "In animal form, such foam articles", delete "provide" and substitute therefore -- provides --.

Figure 18A:
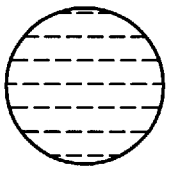
FIGS. 18A, 18D, 18C, 18D, 18E, 18F, 18G, 18H, and 18I represent alternate colors for various parts of the foam toys of the present invention.
Figure 18B:
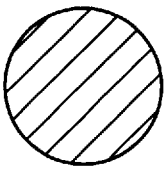
Figure 18C:
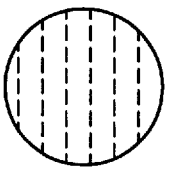
Figure 18D:
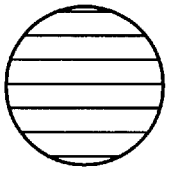
Figure 18E:
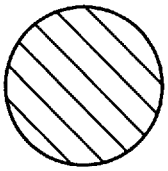
Figure 18F:
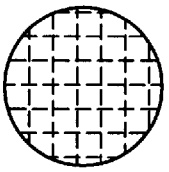
Figure 18G:
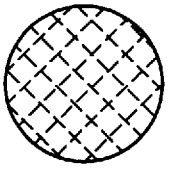
Figure 18H:
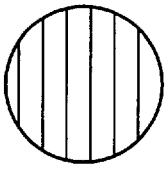
Figure 18I:
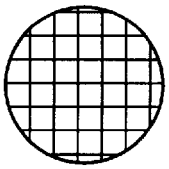

Column 4,
Line 3, after the words "FIGS. 18A," delete "18D" and substitute therefore -- 18B --.
Line 59, after the words "it can" insert -- be --.

Column 5,
Line 18, after the word "similar" insert -- to --.

Column 7,
Line 36, after the word "of" delete the second occurrence of "of".

Column 8,
Line 19, after the words "in the art that" delete "the".

Column 9,
Line 3, delete "ii" and substitute therefore -- (iii) --.

Signed and Sealed this

Fifteenth Day of October, 2002

*Attest:*

*Attesting Officer*

JAMES E. ROGAN
*Director of the United States Patent and Trademark Office*